US009272800B2

(12) United States Patent
Draghetti et al.

(10) Patent No.: US 9,272,800 B2
(45) Date of Patent: Mar. 1, 2016

(54) PACKAGING MACHINE FOR WRAPPING SMOKING ARTICLES

(75) Inventors: Fiorenzo Draghetti, Medicina (IT); Giorgio Vaccari, Bologna (IT)

(73) Assignee: GIMA S.P.A., Zola Predosa (BO) (IT)

( * ) Notice: Subject to any disclaimer, the term of this patent is extended or adjusted under 35 U.S.C. 154(b) by 765 days.

(21) Appl. No.: 13/575,497

(22) PCT Filed: Jan. 26, 2011

(86) PCT No.: PCT/IB2011/000111

§ 371 (c)(1),
(2), (4) Date: Jul. 26, 2012

(87) PCT Pub. No.: WO2011/092570

PCT Pub. Date: Aug. 4, 2011

(65) Prior Publication Data

US 2012/0291398 A1 Nov. 22, 2012

(30) Foreign Application Priority Data

Jan. 26, 2010 (IT) ..... MO2010A0015

(51) Int. Cl.
*B65B 19/22* (2006.01)
*B65B 65/04* (2006.01)

(52) U.S. Cl.
CPC ..... *B65B 19/228* (2013.01); *B65B 19/223* (2013.01); *B65B 65/04* (2013.01); *B65B 2230/04* (2013.01)

(58) Field of Classification Search
CPC .... B65B 65/04; B65B 19/228; B65B 19/226; B65B 19/225; B65B 19/223; B65B 19/22; B65B 2230/04
USPC ..... 53/135.1, 170, 172, 221–225, 228–234
See application file for complete search history.

(56) References Cited

U.S. PATENT DOCUMENTS

| | | | | | |
|---|---|---|---|---|---|
| 3,948,115 | A | * | 4/1976 | Seragnoli | 53/234 |
| 3,956,870 | A | * | 5/1976 | Kruse et al. | 53/234 |
| 4,112,651 | A | * | 9/1978 | Bardenhagen et al. | 53/170 |
| 4,330,976 | A | * | 5/1982 | Blackall et al. | 53/234 |
| 4,596,112 | A | | 6/1986 | Buckley et al. | |
| 4,603,534 | A | * | 8/1986 | Focke | 53/231 |
| 4,711,065 | A | * | 12/1987 | Focke et al. | 53/170 |
| 5,123,226 | A | * | 6/1992 | Near | 53/234 |
| 5,154,035 | A | * | 10/1992 | Cavazza | 53/234 |

(Continued)

FOREIGN PATENT DOCUMENTS

| | | |
|---|---|---|
| DE | 10 2007 004029 | 7/2008 |
| EP | 0553636 | 8/1993 |
| EP | 0619231 | 10/1994 |
| EP | 0716016 | 6/1996 |

(Continued)

*Primary Examiner* — Stephen F Gerrity
(74) *Attorney, Agent, or Firm* — Hamre, Schumann, Mueller & Larson, P.C.

(57) ABSTRACT

A cigarette packaging machine provided with a wrapping wheel to wrap products in wrapping sheets. The wrapping wheel has peripheral pockets to receive the products and the wrapping sheets, a first loading station to load the products in succession into the peripheral pockets, and a second loading station to load, in succession, first wrapping sheets of the wrapping sheets into the peripheral pockets. The wrapping wheel also has a third loading station to load, in succession, second wrapping sheets of the wrapping sheets into the peripheral pockets, thus reducing the bulk of a packaging machine.

17 Claims, 11 Drawing Sheets

(56) References Cited

U.S. PATENT DOCUMENTS

| | | | | |
|---|---|---|---|---|
| 5,461,841 | A * | 10/1995 | Spada et al. | 53/234 |
| 6,189,296 | B1 * | 2/2001 | Spatafora et al. | 53/234 |
| 6,357,208 | B1 * | 3/2002 | Spatafora | 53/234 |
| 2001/0052217 | A1 * | 12/2001 | Spatafora | 53/234 |
| 2005/0005580 | A1 * | 1/2005 | Spatafora et al. | 53/234 |
| 2005/0126128 | A1 * | 6/2005 | Spatafora | 53/234 |
| 2006/0267536 | A1 * | 11/2006 | Linke | 318/625 |
| 2012/0297737 | A1 * | 11/2012 | Draghetti | 53/461 |

FOREIGN PATENT DOCUMENTS

| | | | | |
|---|---|---|---|---|
| EP | 0776832 | | 6/1997 | |
| EP | 1035021 | | 9/2000 | |
| EP | 1396430 | | 3/2004 | |
| EP | 1475306 | A1 * | 11/2004 | B65B 19/223 |
| EP | 1574434 | A2 * | 9/2005 | B65B 19/225 |
| EP | 1712470 | | 10/2006 | |
| GB | 1481204 | A * | 7/1977 | B65B 19/226 |
| GB | 2132975 | | 7/1984 | |
| IT | 1158537 | | 2/1987 | |

* cited by examiner

PACKAGING MACHINE FOR WRAPPING SMOKING ARTICLES

The invention concerns a packaging machine provided with a wrapping wheel disposed to wrap, at least partially, a product, in particular a group of cigarettes wrapped by an inner wrapping sheet, in further wrapping sheets, in particular in an inner containing element, or collar, and in an outer wrapping sheet.

The Italian patent IT1158537 describes a packaging machine, extending mainly in a longitudinal direction, in order to pack cigarettes in rigid packets of the type with a hinged lid. The machine comprises a forming drum including tubular cells cooperating with forming elements to form groups of cigarettes wrapped in a sheet of silver paper.

The forming drum is rotatable step-wise around a horizontal rotation axis along a circular forming path along which each of the above groups of cigarettes is wrapped by a respective sheet of silver paper. In particular, the forming path is contained in a vertical forming plane.

The packaging machine described in IT1158537 also comprises a first wrapping conveyor extending in the first longitudinal direction and positioned mainly downstream and below the forming drum.

The first wrapping conveyor includes a plurality of first wrapping pockets to wrap each of the above groups of cigarettes previously wrapped by the sheet of silver paper, with a respective inner containing element, or collar, the latter being intended to form, in the finished rigid packet, an inner containing element.

Each of the above first wrapping pockets is disposed to receive, in correspondence to a first loading station included in the first wrapping conveyor, a respective collar and, in correspondence to a second loading station included in the first wrapping conveyor, a group of cigarettes wrapped in the sheet of silver paper so as to wrap the latter with a respective collar.

In particular, the above first conveyor is an endless belt closed as a ring around two first pulleys rotatable around first horizontal axes and parallel to the axis of rotation of the forming drum; the first conveyor advances along a first wrapping path along which each of the above groups of cigarettes wrapped in the sheet of silver paper is wrapped by a respective collar.

The first wrapping path is contained in a respective first vertical wrapping plane, parallel to and positioned at the front of the above forming plane. In this way, the first wrapping conveyor is positioned at the front, in a second direction, perpendicular with respect to the above first direction, with respect to the forming drum.

The packaging machine described in IT1158537 also comprises a first thruster element to transfer each of the groups of cigarettes wrapped in the sheet of silver paper from a respective tubular cell to a respective first wrapping container in correspondence to the second loading station of the first wrapping conveyor.

The first thruster element moves the groups of cigarettes wrapped in the sheet of silver paper in a first transfer direction, rectilinear and parallel to the above first horizontal axes, so as to axially transfer the groups of cigarettes wrapped in the sheet of silver paper from the wrapping drum to the first wrapping conveyor.

To be more exact, the first transfer direction is contained in a first transfer plane perpendicular to the forming plane and to the first wrapping plane.

The packaging machine described in IT1158537 also comprises a transfer conveyor extending in the above first direction and positioned downstream of the wrapping conveyor.

The transfer conveyor includes a plurality of compartments to transport outer wrapping sheets intended to form the external walls of a relative packet.

The transfer conveyor is an endless belt closed as a ring around two pulleys rotatable around horizontal axes and parallel to the above first horizontal axes of the first wrapping conveyor; the transfer conveyor advances step-wise along a transport path.

The transport path is contained in a vertical transport plane, parallel and offset with respect to the above forming plane and first wrapping plane.

The packaging machine described in IT1158537 also comprises a second wrapping conveyor extending in the above first longitudinal direction and positioned mainly downstream and below the first wrapping conveyor.

The second wrapping conveyor includes a plurality of second wrapping pockets in order to partially wrap each of the above groups of cigarettes, previously wrapped by the sheet of silver paper and by the collar, with a respective outer wrapping sheet.

Each of the above second wrapping pockets is disposed to receive from the above transfer conveyor, in correspondence to a further first loading station included in the second wrapping conveyor, a respective outer wrapping sheet, and from the first wrapping conveyor, in correspondence to a further second loading station included in the second wrapping conveyor and to a third unloading station of the first conveyor, a group of cigarettes wrapped by the sheet of silver paper and the collar so as to partially wrap the group of cigarettes wrapped by the sheet of silver paper with a respective outer wrapping sheet.

In particular the above second conveyor is an endless belt closed as a ring around two second pulleys rotatable around second axes, horizontal and parallel to the above first horizontal axes of the first wrapping conveyor and to the above horizontal axes of the transfer conveyor; the second conveyor advances step-wise along a second wrapping path along which each of said groups of cigarettes wrapped by the sheet of silver paper and the collar is partially wrapped by a respective outer wrapping sheet.

The second wrapping path is contained in a respective second vertical wrapping plane, parallel and positioned at the front with respect to the above first wrapping plane. In this way the second wrapping conveyor is positioned at the front, in said second direction, with respect to the first wrapping conveyor.

The packaging machine described in IT1158537 also comprises a second thruster element to transfer each of the above groups of cigarettes wrapped by the sheet of silver paper and the collar from a respective first pocket to a respective second pocket in correspondence to the further second loading station of the second wrapping conveyor and the third unloading station of the first conveyor.

The second thruster element moves the groups of cigarettes wrapped by the sheet of silver paper and the collar in a second transfer direction, rectilinear and parallel with respect to the first transfer direction, so as to transfer axially the groups of cigarettes wrapped by the sheet of silver paper and collar from the first wrapping conveyor to the second wrapping conveyor.

To be more exact, the second transfer direction is contained in a second transfer plane perpendicular to the forming plane, to the first wrapping plane and to the second wrapping plane, and is parallel and offset with respect to the first transfer plane.

The packaging machine described in IT1158537 also comprises a third wrapping conveyor extending in the above first longitudinal direction, and positioned mainly downstream and above the second wrapping conveyor.

The third wrapping conveyor includes a plurality of third wrapping pockets in order to complete the wrapping of the outer wrapping sheet around each of the above groups of cigarettes previously wrapped by the sheet of silver paper and by the collar.

Each of the above third wrapping pockets is disposed to receive in succession from the second wrapping conveyor described above, in correspondence to another further first loading station included in the third wrapping conveyor and another third unloading station of the second conveyor, a respective group of cigarettes wrapped by the sheet of silver paper, by the collar and partially by the outer wrapping sheet.

In particular, the above third wrapping conveyor is an endless belt closed as a ring around two third pulleys rotatable around third axes horizontal and parallel to the above first horizontal axes of the first wrapping conveyor and to the above second horizontal axes of the second wrapping conveyor; the third conveyor advances step-wise along a third wrapping path along which each of the above groups of cigarettes is completely wrapped by the respective outer wrapping sheet.

The third wrapping path is contained in a respective third vertical wrapping plane, parallel and positioned at the rear with respect to the above first and second wrapping planes. In this way, the third wrapping conveyor is positioned at the rear, in the above second direction, with respect to the first wrapping conveyor and to the second wrapping conveyor.

The packaging machine described in IT1158537 is also provided with a third thruster element to transfer each of the above groups of cigarettes, partially wrapped by the outer wrapping sheet, from a respective second container to a respective third container in correspondence to the other further first loading station of the third wrapping conveyor and the further third unloading station of the second conveyor.

The third thruster element moves the groups of cigarettes partially wrapped by the outer wrapping sheet in a third transfer direction, rectilinear and parallel with respect to the first and the second transfer direction, so as to transfer axially the groups of cigarettes partially wrapped by the outer wrapping sheet from the second wrapping conveyor to the third wrapping conveyor.

To be more exact, the third transfer direction is contained in a third transfer plane perpendicular to the forming plane, to the first wrapping plane, to the second wrapping plane and to the third wrapping plane, and is parallel and offset with respect to the first transfer plane and to the second transfer plane.

One defect of the packaging machine described above is that it is particularly bulky, structurally complex and costly.

Indeed it needs at least two subsequent wrapping conveyors, suitably positioned spatially, to at least partially wrap, with a collar and an outer wrapping sheet, a group of smoking articles previously wrapped in a sheet of silver paper.

One purpose of the present invention is to improve the wrapping wheels of packaging machines.

A further purpose is to provide more compact packaging machines which are structurally more simple and more economic with respect to known packaging machines.

Another purpose is to provide a packaging machine lying on a single plane, substantially vertical, so that the various operating members are easily accessible, can be controlled and are easy to install and maintain.

It is also a purpose to provide that the plurality of the operating members have a circular conformation around the periphery of which the connected specialized operations are carried out, so as to maximize the use of space, simplify management and improve the result.

Another purpose is to provide that the plurality of kinematic members are driven independently, even though they are coordinated with the other operating members, by their own electric command motor, driven step-wise, of the brushless type.

It is also a purpose to provide that most of the insertions occur in a radial direction.

According to the invention, a packaging machine to form packets of smoking articles, in particular cigarettes, comprises a central wrapping wheel, to wrap, at least partially, at least a group of smoking articles, previously wrapped by a relative first inner wrapping sheet, usually aluminum, silver or metalized paper, in a respective inner containing element, or collar, and in a respective second wrapping sheet, substantially flat; the wrapping wheel lies on a single plane, advantageously placed vertically, and comprises peripheral pockets that accommodate the at least one group of smoking articles, the respective collar and the respective second wrapping sheet. The following cooperate with the wrapping wheel:

positioning means lying on a substantially vertical plane and which position the collar sequentially into the peripheral pockets, moving it in a radial direction to the wrapping wheel;

transfer means lying on a substantially vertical plane and which transfer a group of smoking articles already wrapped by an inner wrapping sheet in a radial direction to the wrapping wheel, removing it from movement means substantially orthogonal to the lying plane;

wheel-type transfer means lying on a substantially vertical plane and which deliver the second wrapping sheet in a radial direction to the suction cup retaining means, in cooperation with the respective peripheral pockets of the wrapping wheel;

wheel-type final packaging and wrapping means, lying on a substantially vertical plane and which receive radially from the central wrapping wheel the material introduced therein on each occasion so as to form the packets.

It is also within the spirit of the invention to provide that at least the wrapping wheel, the positioning means, the wheel-type transfer means and the wheel-type final packaging and wrapping means are associated to their own electric step motors, of the brushless type.

The electric step motors are governed by a central command and control unit of the programmable type.

Thanks to this disposition it is possible to reduce the bulk of the packaging machine, at the same time simplifying the assembly, control, drive and coordination of the various components and the maintenance thereof.

In other words, this makes it possible to wrap, at least partially, the products on one single wrapping wheel, instead of on two wrapping conveyors, thus making it unnecessary to have two separate wrapping conveyors with their respective loading/unloading stations.

It is obvious that this renders the wrapping wheel more structurally simple and less costly with respect to the known packaging machines.

The invention will be understood and actuated more easily with reference to the attached drawings, which show some non-restrictive examples of forms of embodiment wherein.

Figure 1:
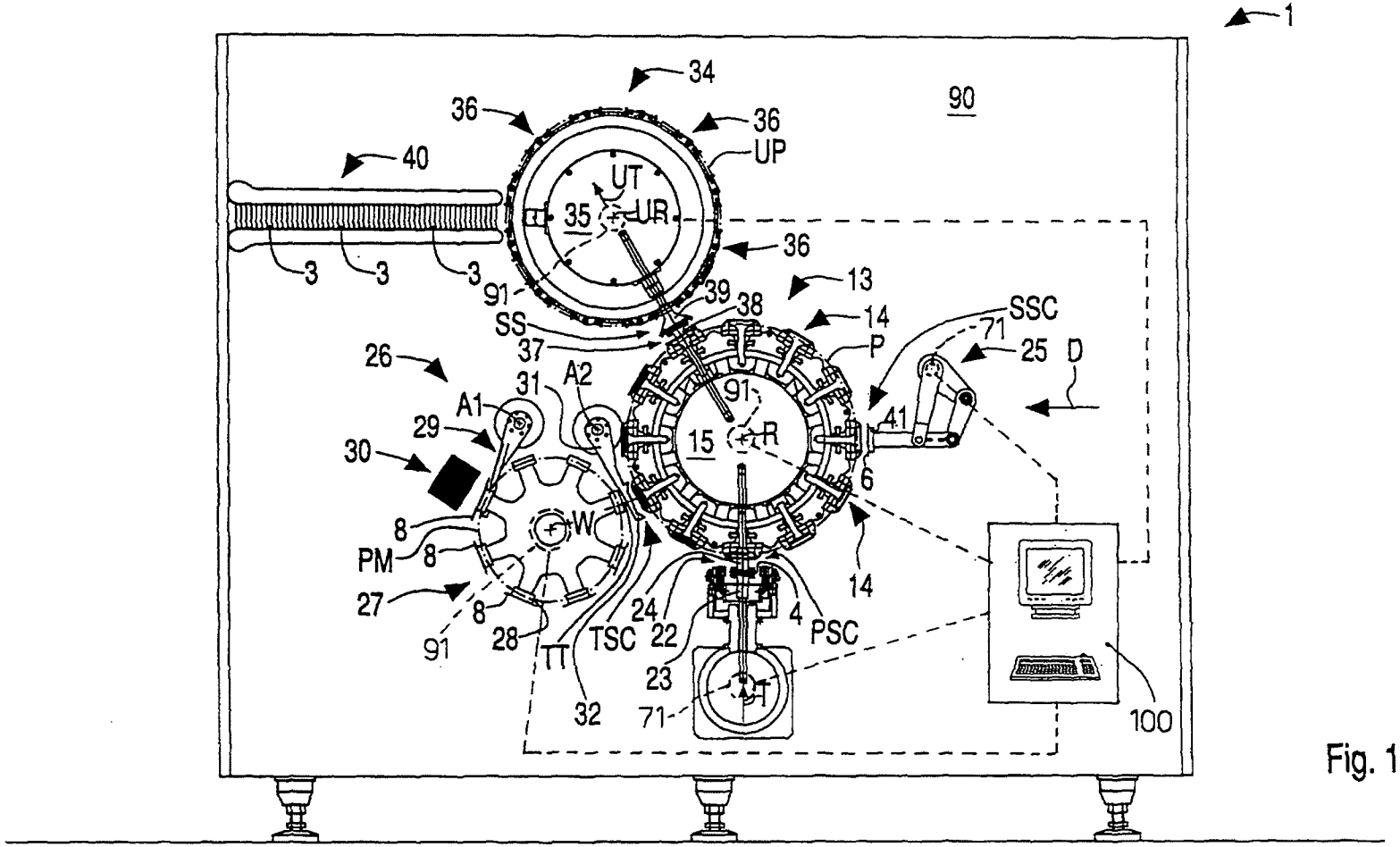
FIG. 1 is a front schematic view of a first version of a packaging machine including the wrapping wheel according to the invention.

FIG. 1 shows a packaging machine 1 to package smoking articles 2 (FIG. 5), in particular cigarettes, in packets 3 (FIG. 20), for example of a substantially parallelepiped shape.

Figure 5:
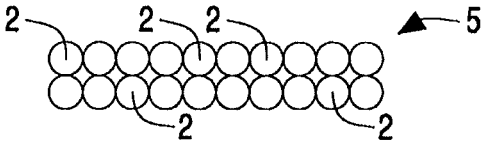
FIG. 5 is a front schematic view of a group of smoking articles.
Figure 6:
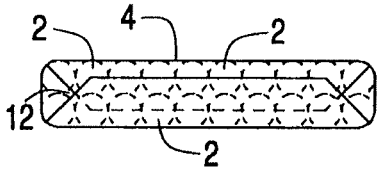
FIG. 6 is a front schematic view of a group of smoking articles in FIG. 5 wrapped in an inner wrapping sheet.

The packets 3 are of the rigid type, comprising, once formed, an inner wrapping sheet 4 (FIG. 6), for example a sheet of silver or metalized paper, housing and wrapping a group, or arrangement of cigarettes (FIG. 5).

Figure 7:
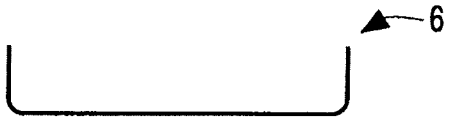
FIG. 7 is a front schematic view of an inner containing element, or collar, of a packet of smoking articles.
Figure 20:
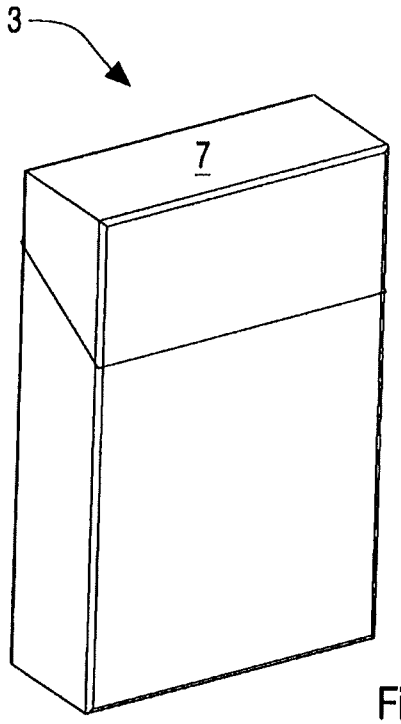
FIG. 20 is a perspective view of a packet of smoking articles.

The packets 3 also include a first wrapping sheet 6, or inner containing element, or collar, (FIG. 7), made of cardboard for example, possibly coupled with a sheet of metal, at least partially wrapping the inner wrapping sheet 4, and disposed among other things to stiffen the packet 3 and keep a lid 7 of the latter closed (FIG. 20).

Figure 4:
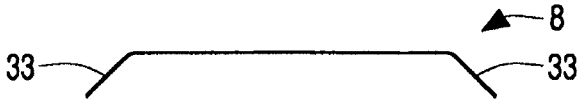
FIG. 4 is a front schematic view of a punched piece intended to form an external casing of a packet of smoking articles.

Furthermore, the packets 3 comprise a second wrapping sheet 8, or punched piece (FIG. 4), intended to form the external walls of the packets 3 and therefore to wrap the collar 6 and the group of cigarettes 5 packed in the inner wrapping sheet 4.

The packaging machine 1 comprises a forming conveyor, of a known type, not shown, to at least partially wrap the groups of cigarettes 5 in relative inner wrapping sheets 4.

Figure 3:
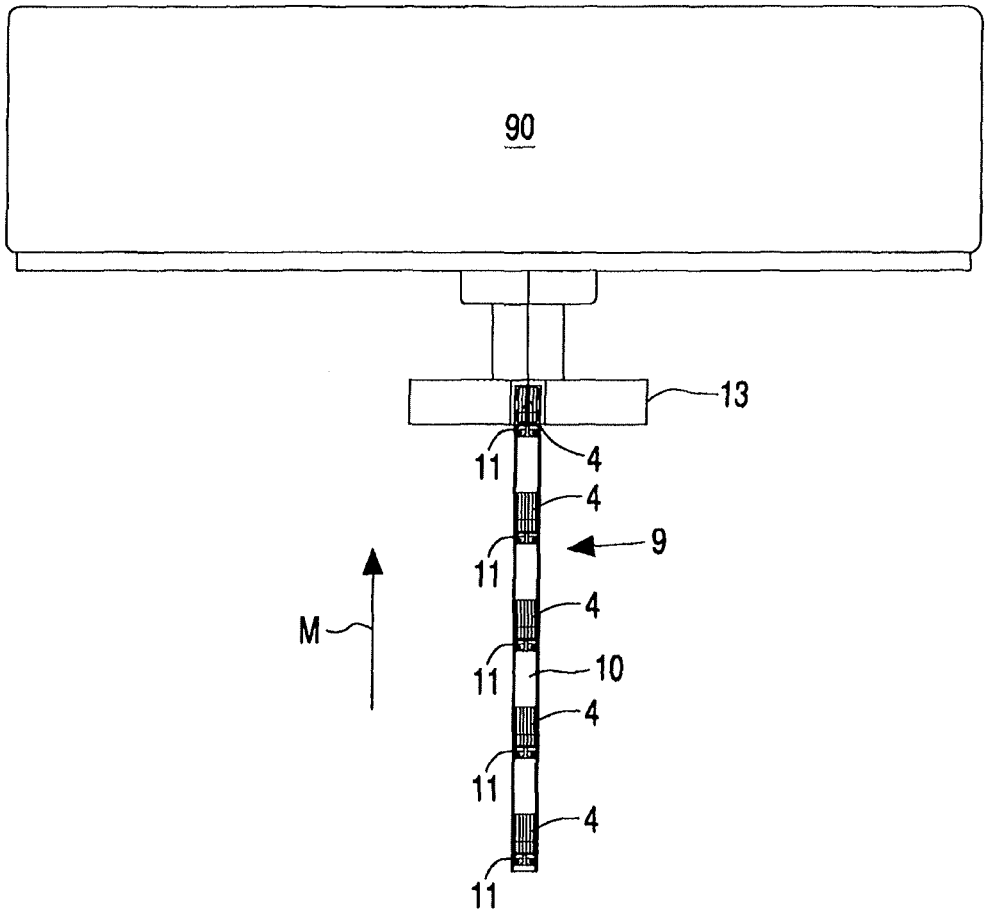
FIG. 3 is a schematic view from above, with some details removed in order to highlight others, of the packaging machine in FIG. 1.

The packaging machine 1 also includes movement means 9 (FIG. 3) to move the groups of cigarettes 5 at least partially wrapped in the relative inner wrapping sheets 4 in a substantially horizontal movement direction M.

In particular, the groups of cigarettes 5 are moved so that the filters of the cigarettes are positioned upstream of the tobacco of the cigarettes with respect to the movement direction M.

The movement means 9 comprise an endless belt 10 closed in a ring around two pulleys, not shown, rotatable around respective horizontal axes and advancing with variable motion in the movement direction M.

To be more exact, the movement means 9 are driven by an electric motor, not shown.

The movement means 9 also comprise a plurality of abutment elements 11, attached to the endless belt 10 and extending transversely with respect to the movement direction M, disposed to abut on a minor side 12 (FIG. 6) of the groups of cigarettes 5 wrapped in the relative inner wrapping sheets 4 so as to move the latter in the movement direction M.

The packaging machine 1 also comprises a wrapping wheel 13 (FIG. 1) to at least partially wrap, in sequence, each group of cigarettes 5, previously wrapped by a relative inner wrapping sheet 4, in a respective collar 6 and in a respective second wrapping sheet 8.

The wrapping wheel 13 is able to move the groups of cigarettes 5 along a wrapping path P shown with the broken/dotted line in FIG. 1.

Along the wrapping path P, substantially circular, around each of the groups of cigarettes 5 wrapped in the relative inner wrapping sheets 4, a relative collar 6 and, at least partially, a relative second wrapping sheet 8 are folded.

The wrapping wheel 13 is made to rotate, step-wise, by an electric motor 91, advantageously a step motor of the brushless type, around an axis of rotation R substantially parallel to the movement direction M.

Figure 8:
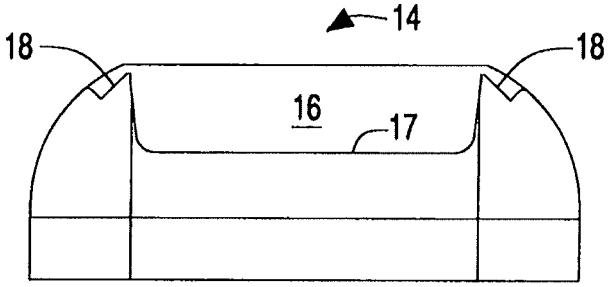
FIG. 8 is a front schematic view of a pocket included in the packaging machine in FIG. 1.
Figure 9:
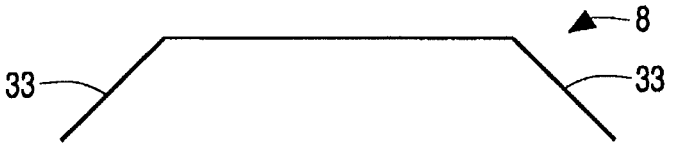
FIG. 9 is a front schematic view of a further punched piece intended to form an external casing of a further packet of smoking articles.
Figure 10:
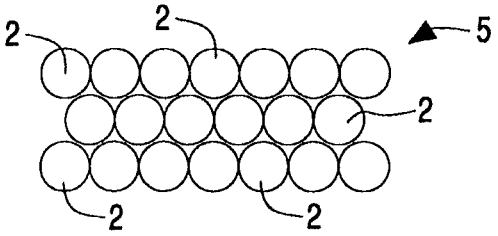
FIG. 10 is a front schematic view of a further group of smoking articles.
Figure 11:
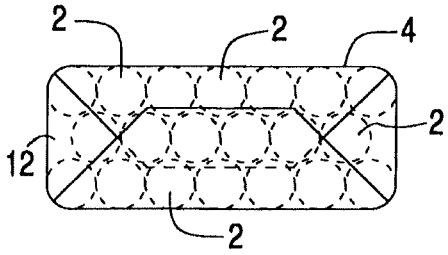
FIG. 11 is a front schematic view of the group of smoking articles in FIG. 10 wrapped in an inner wrapping sheet.

The wrapping wheel 13 comprises a disc shaped body 15, supporting a plurality of peripheral pockets 14 (FIG. 8) positioned in a radial manner.

The peripheral pockets 14 comprise respective compartments 16 to receive, as will be described more fully hereafter, the groups of cigarettes 5 wrapped by the inner wrapping sheet 4, the collars 6 and the second wrapping sheets 8.

Each compartment 16 has an abutment profile 17 in the shape of a "U". Moreover, each peripheral pocket 14 comprises lateral walls 18 connected and positioned externally with respect to the abutment profile 17.

Each peripheral pocket 14 is also provided with retaining means, not shown, in order to hold the collars 6 against the abutment profile 17. In particular, the retaining means comprise one or more suction cups.

Figure 14:
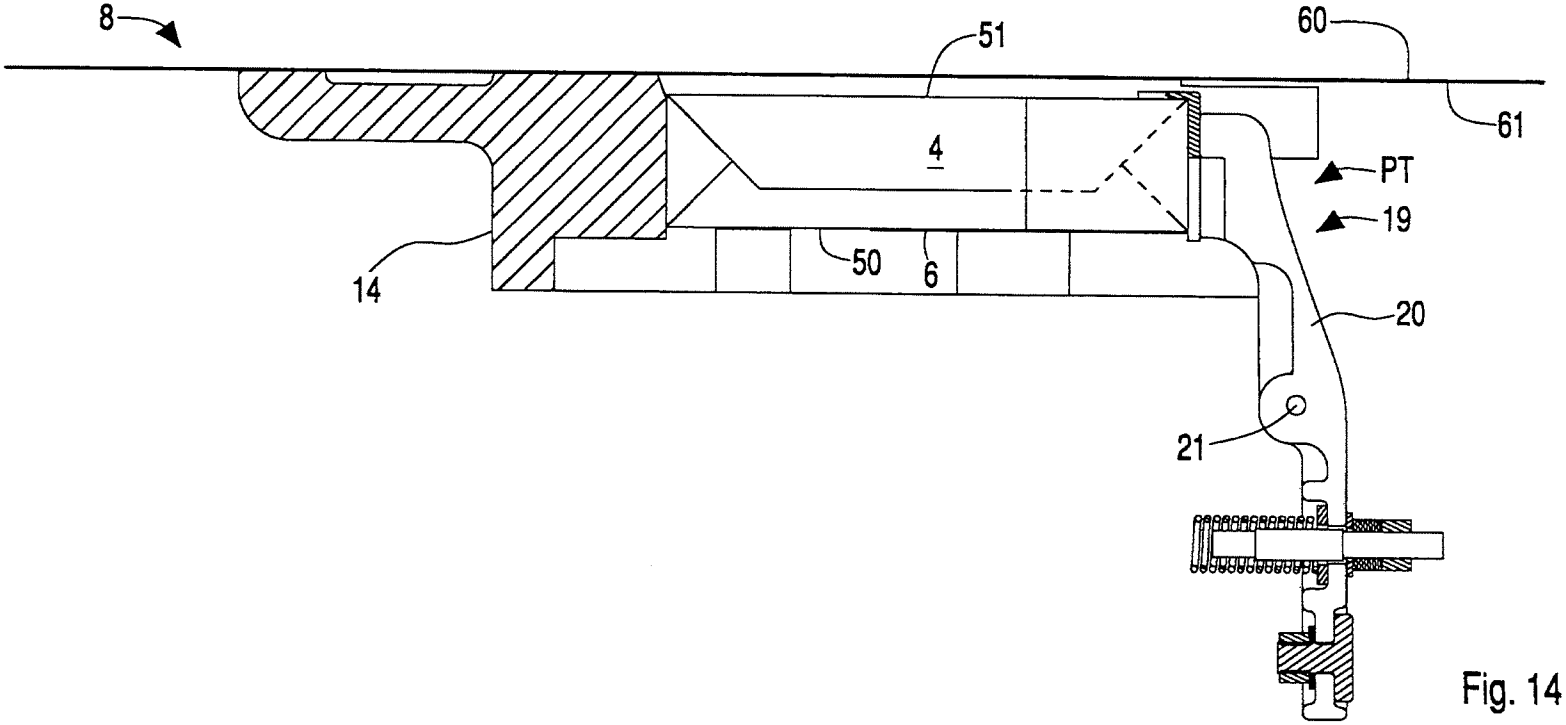
FIG. 14 is a cross section of the pocket in FIG. 8.

Furthermore, each peripheral pocket 14 comprises anchoring means 19 (FIG. 14) in order to retain, in the compartment 16, the groups of cigarettes 5 wrapped by the inner wrapping sheet 4 and at least partially by the collars 6.

The anchoring means 19 comprise an anchoring element 20, also called "hoe" by persons of skill in the field, substantially L-shaped, rotatable around a pin 21 between a release position, not shown, which allows to insert into or withdraw from the compartment 16 the group of cigarettes 5 wrapped by the inner wrapping sheet 4 and at least partially by the collars 6, and a retaining position PT (FIG. 14), in which it retains the groups of cigarettes 5 wrapped by the inner wrapping sheet 4 and at least partially by the collars 6.

In particular, the anchoring element 20 is moved between the release position and the retaining position PT by relative drive means, not shown.

The packaging machine 1 also comprises transfer means 22 (FIG. 1) to transfer the groups of cigarettes wrapped by the inner wrapping sheet 4 from the movement means 9 to the wrapping wheel 13.

To be more exact, the transfer means 22 transfer the groups of cigarettes 5 wrapped by the inner wrapping sheet 4 in a transfer direction T which is radial with respect to the wrapping path P.

In particular, the transfer direction T is substantially perpendicular to the movement direction M.

The transfer means 22 comprise a first thruster element 23 and a second thruster element 24 cooperating with each other in order to retain and insert in succession into each compartment 16, one of the groups of cigarettes 5 wrapped by the inner wrapping sheet 4. In particular the first thruster element 23 and the second thruster element 24 are driven with alternate motion, as will be explained in more detail hereafter, and, in plane, have a shape such that they are able to be inserted, without knocking against the walls, into a passage, not shown, made inside the peripheral pockets 14.

The groups of cigarettes 5 wrapped by the inner wrapping sheet 4 are inserted into a relative compartment 16 so that a bigger side 50 (FIG. 14) of the groups of cigarettes 5 wrapped in the inner wrapping sheets 4 faces the respective compartment 16.

The first thruster element 23 and the second thruster element 24, mutually facing, are slidingly supported respectively by the movement means 9 and by the wrapping wheel 13 and are positioned in correspondence to a first loading station PSC of the wrapping wheel 13.

Figure 15:
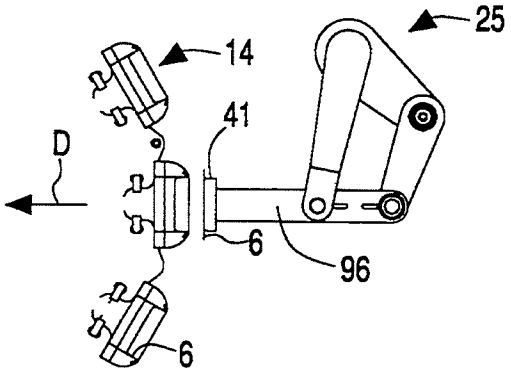
FIG. 15 is an enlarged detail of FIG. 1.

The packaging machine 1 also comprises positioning means 25 (FIGS. 1 and 15) to position in succession a respective collar 6 in each compartment 16.

In particular, the positioning means 25, disposed in correspondence to a second loading station SSC of the wrapping wheel 13, are driven with alternate motion, as will be explained more fully hereafter, and move the collars 6 in a direction D, which is substantially rectilinear and radial with respect to the wrapping path P.

In particular the second loading station SSC is positioned upstream of the first loading station PSC with respect to the wrapping path P.

The positioning means 25 include a punch element 41 conformed so as to be able to be inserted, at least partially, in a compartment 16, and provided with one or more suction cups, not shown, in order to retain and move, one at a time, the collars 6.

The packaging machine 1 also comprises further transfer means 26 (FIG. 1) to transfer in succession each second wrapping sheet 8 onto a relative peripheral pocket 14 above a respective group of cigarettes 5 packed in an inner wrapping sheet 4 and at least partially wrapped by a collar 6.

In particular the further transfer means 26 are positioned in correspondence to a third loading station TSC of the wrapping wheel 13, the third loading station TSC being positioned downstream of the first loading station PSC with respect to the wrapping path P.

The further transfer means 26 comprise a transfer wheel 27 provided radially with a plurality of retaining elements 28 disposed in order to each retain a respective second wrapping sheet 8.

In particular the transfer wheel 27 is able to move the second wrapping sheets 8 by means of the retaining elements 28, along a movement path PM, shown with a broken/dotted line in FIG. 1, substantially circular and substantially coplanar to the wrapping path P.

Furthermore, the transfer wheel 27 is made to rotate stepwise by an electric motor 91, advantageously a step motor of the brushless type, (only shown schematized in FIG. 1), around an axis W substantially parallel to the rotation axis R.

To be more exact, the direction of rotation of the transfer wheel 27 is opposite to the direction of rotation of the wrapping wheel 13.

The further transfer means 26 also comprise a first transfer arm 29 in order to transfer in succession the second wrapping sheets 8 between a store 30 of second wrapping sheets 8 and one of the retaining elements 28.

In particular the first transfer arm 29 is driven with alternate motion, as will be described more fully hereafter, and rotates around a first rotation axis A1 substantially parallel to the axis W.

The further transfer means 26 are also provided with a second transfer arm 31 in order to transfer in succession the second wrapping sheets 8 between one of the retaining elements 28 and a relative peripheral pocket 14 above a group of cigarettes 5 packed in the inner wrapping paper 4 and at least partially wrapped by a collar 6.

In particular the second transfer arm 31 is driven with alternate motion, as will be explained more fully hereafter, and rotates around a second axis of rotation A2 substantially parallel to the axis W.

To be more exact, the second transfer arm 31 moves the second wrapping sheets 8 along a transfer trajectory TT, shown with a broken/dotted line in FIG. 1, substantially rectilinear and radial with respect to the wrapping path P.

Furthermore, the second transfer arm 31 comprises an end portion 32, having a profile like a "C", in order to fold toward the inside peripheral zones 33 (FIG. 4) of each second wrapping sheet 8 and make them abut against respective lateral walls 18 of a relative peripheral pocket 14.

The packaging machine 1 also comprises a further wrapping wheel 34 (FIG. 1), of the known type and therefore not described in detail, in order to complete the folding of the second wrapping sheets 8 around the groups of cigarettes 5, previously wrapped in the inner wrapping sheets 4 and in the collars 6, so as to form the packets 3.

In particular, the further wrapping wheel 34 is able to move the groups of cigarettes 5, packed in the inner wrapping sheets 4 and wrapped in the collars 6 and, at least partially, in the second wrapping sheets 8, along a further wrapping path UP, shown with a broken/dotted line in FIG. 1, substantially circular, along which, around each of the groups of cigarettes 5, previously wrapped in a relative inner wrapping sheet 4 and in a collar 6, a relative second wrapping sheet 8 is completely folded in order to form the packet 3.

In particular, the further wrapping wheel 34 is made to rotate step-wise by an electric motor 91, advantageously a step motor of the brushless type (only shown schematized in FIG. 1), around a further axis of rotation UR substantially parallel to the axis of rotation R; the direction of rotation of the further wrapping wheel 34 is opposite the direction of rotation of the wrapping wheel 13.

Furthermore, the further wrapping wheel 34 is substantially coplanar to the wrapping wheel 13 and the transfer wheel 27.

The further wrapping wheel 34 comprises a further discoid body 35, supporting a plurality of further peripheral pockets 36 positioned radially so as to receive the groups of cigarettes 5 packed in the inner wrapping sheets 4 and wrapped by the collars 6 and by the second wrapping sheets 8. The packaging machine 1 also comprises other transfer means 37 (FIG. 1) in order to transfer, in succession, a relative group of cigarettes 5 packed in an inner wrapping sheet 4 and at least partially wrapped by a collar 6 and by a second wrapping sheet 8, from each of the peripheral pockets 14 to each of the further peripheral pockets 36.

To be more exact, the other transfer means 37 transfer the groups of cigarettes 5 packed in inner wrapping sheets 4 and at least partially wrapped by collars 6 and by second wrapping sheets 8, in a further transfer direction UT which is radial with respect to the wrapping path P.

In particular, the further transfer direction UT is transverse to the movement direction M and is substantially coplanar to the transfer direction T.

The other transfer means 37 comprise a further first thruster element 38 and a further second thruster element 39 cooperating with each other to retain, and insert in succession into each further peripheral pocket 36, a relative group of cigarettes 5, packed in an inner wrapping sheet 4 and at least partially wrapped by a collar 6 and by a second wrapping sheet 8.

In particular, the further first thruster element 38 and the further second thruster element 39 are driven with alternate motion, as will be explained more fully hereafter, and, in plane, have a shape such as to be able to be inserted, without knocking against the walls, into passages (not shown) made inside the peripheral pockets 14 and the further peripheral pockets 36.

The groups of cigarettes 5 wrapped by the inner wrapping sheet 4 are inserted into a relative further peripheral pocket 36 so that the relative second wrapping sheet 8 faces, with a face 60 (FIG. 14), a relative further peripheral pocket 36, a further face 61 of the second wrapping sheet 8, opposite the above face 60, facing a further bigger side 51 (FIG. 14), opposite the bigger side 50, of the groups of cigarettes 5 wrapped in the relative inner wrapping sheets 4.

The further first thruster element 38 and the further second thruster element 39, mutually facing, are slidingly supported respectively by the wrapping wheel 13 and by the further wrapping wheel 34 and are positioned in correspondence to an unloading station SS of the loading wheel 13.

The unloading station SS is positioned downstream of the third loading station TSC along the wrapping path P.

The packaging machine 1 also comprises an unloading conveyor 40 (FIG. 1), of the known type and therefore not described in detail, to pick up the packets 3 formed by the further wrapping wheel 34 and to unload them radially from the packaging machine 1.

During functioning, the positioning means 25 radially position a respective collar 6, in succession, in each empty peripheral pocket 14, in correspondence to the second loading station SSC.

Each collar 6 is subsequently retained, by means of the above retaining means, against the abutment profile 17, the punch element 41 and the abutment profile 17 cooperating to fold each collar 6 to a "U". Subsequently, the collars 6 are moved along the wrapping path P and are stopped in succession in correspondence to the first loading station PSC.

In the first loading station PSC the transfer means 22 radially transfer, in succession, each group of cigarettes 5, previously at least partially packed in a relative inner wrapping sheet 4, from the movement means 9 to the wrapping wheel 13 into a respective compartment 16 retaining a collar 6. In this way, each group of cigarettes 5 packed in a relative inner wrapping sheet 4 is wrapped on three sides by a respective collar 6.

Subsequently again, the anchoring means 19 of the peripheral pocket 14 positioned in the first loading station PSC are moved from the release position to the retaining position PT, so as to keep anchored to the peripheral pocket 14 the group of cigarettes 5 packed in the inner wrapping sheet 4 and at least partially wrapped, that is, on three sides, by the collar 6.

Subsequently, the groups of cigarettes 5 packed in the inner wrapping sheets 4 and at least partially wrapped by the collars 6, are moved along the wrapping path P and are stopped in succession in correspondence to the third loading station TSC. In the third loading station TSC the further transfer means 26 transfer radially, in succession, each second wrapping sheet 8 onto a relative peripheral pocket 14 above a relative group of cigarettes 5 packed in an inner wrapping sheet 4 and at least partially wrapped by a respective collar 6.

In correspondence to the third loading station TSC, the retaining means of the peripheral pocket 14 are driven, positioned in correspondence to the lateral walls, in order to retain the second wrapping sheet 8 anchored to the peripheral pocket 14.

Subsequently the group of cigarettes 5 packed in the inner wrapping sheets 4 and at least partially wrapped by the collars 6 and by the second wrapping sheets, are moved along the wrapping path P and are stopped in succession in correspondence to the unloading station SS.

In the unloading station SS the retaining means of the peripheral pocket 14 are released and the anchoring means 19 are moved into the release position, so as to allow the other transfer means 37 to transfer radially, in succession, a relative group of cigarettes 5 packed in an inner wrapping sheet 4 and at least partially wrapped by a collar 6 and by a second wrapping sheet 8, from each of the peripheral pockets 14 to each of the further peripheral pockets 36.

Subsequently again, each group of cigarettes 5 packed in an inner wrapping sheet 4 and at least partially wrapped by a collar 6 and by a second wrapping sheet 8, is moved by the further wrapping wheel 34 along the further wrapping path UP along which, around each of the groups of cigarettes 5, a relative second wrapping sheet 8 is wrapped in order to form the packet 3.

Subsequently, the packets 3 thus formed are radially transferred to the unloading conveyor 40 and unloaded from the packaging machine 1.

In one version of the invention, not shown, the axis of rotation R is substantially perpendicular to the movement direction M.

Figure 2:
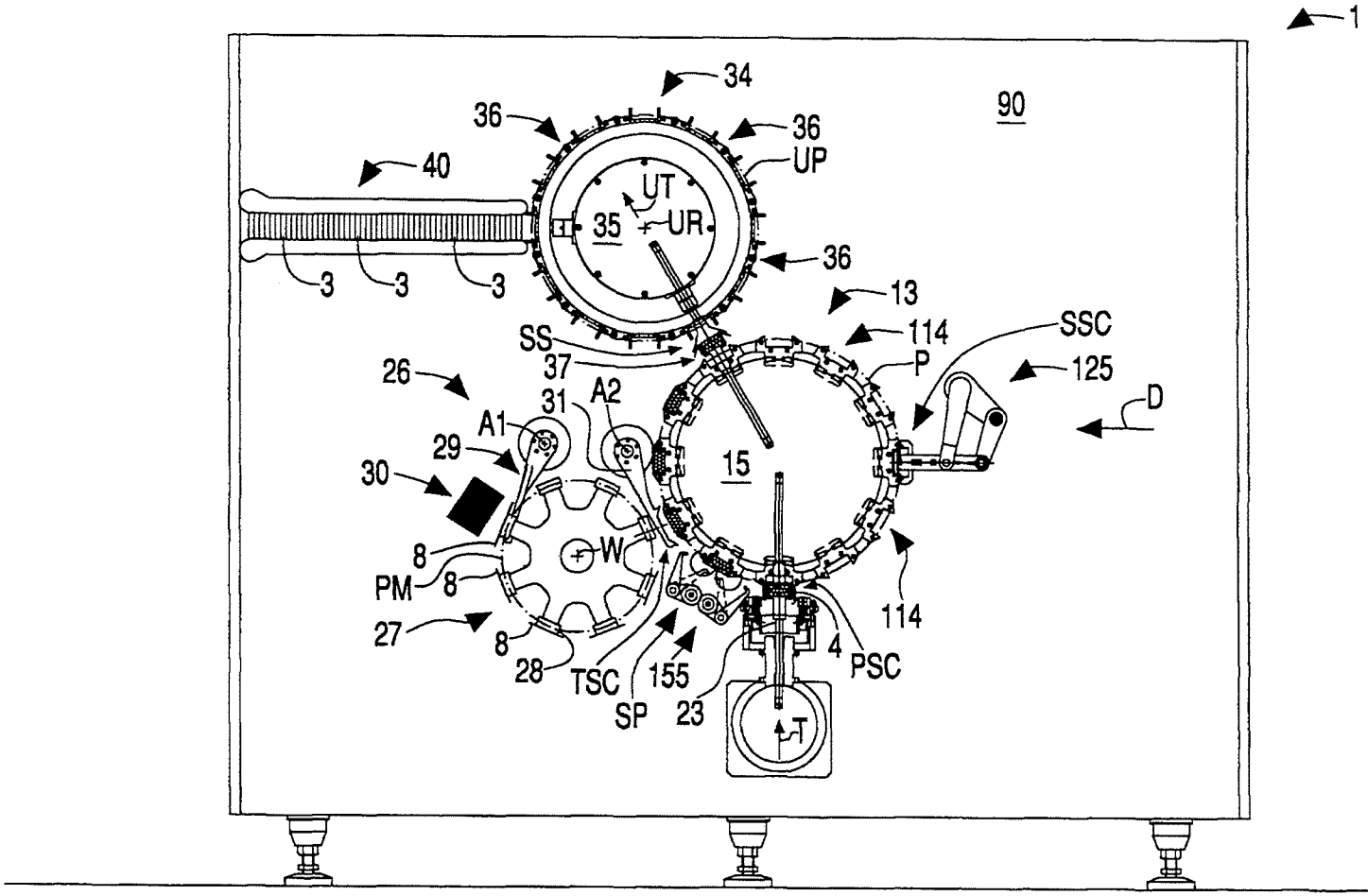
FIG. 2 is a view like that in FIG. 1 of a second version of a packaging machine including the wrapping wheel according to the invention.

In a further version of the invention, shown in FIG. 2, the packaging machine 1 is modified so as to be able to fold collars 106 (FIG. 12) around four sides of the groups of cigarettes 5 packed in the inner wrapping sheets 4.

Figure 13:
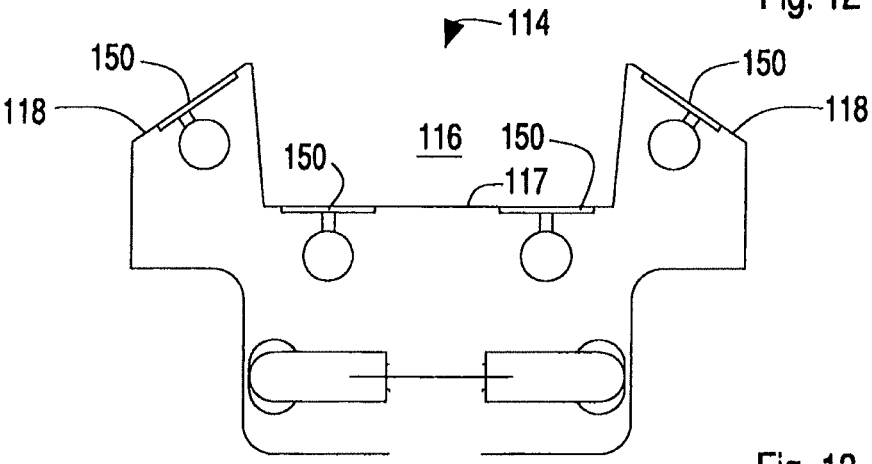
FIG. 13 is a front schematic view of a further pocket included in the packaging machine in FIG. 2.

In a further version, the peripheral pockets 14 are substituted by other peripheral pockets 114 on the wrapping wheel 13 (FIG. 13).

It should be noted that different types of peripheral pockets can be assembled on the wrapping wheel 13, depending on the format of the packets 3 to be made.

In other words the peripheral pockets can have different formats.

Each peripheral pocket 114 comprises a compartment 116 including an abutment profile 117 in the shape of a "U".

Moreover, each peripheral pocket 114 comprises external walls 118 connected and positioned externally with respect to the abutment profile 117.

In particular the external walls 118 are inclined toward the outside.

Each peripheral pocket 114 is also provided with retaining means 150, structurally and functionally similar to the retaining means of the peripheral pockets 14, in order to retain the collars 106 against the abutment profile 117.

In particular the retaining means comprise several suction cups 150.

Each peripheral pocket 114 is also provided with anchoring means 19, not shown.

Figure 16:
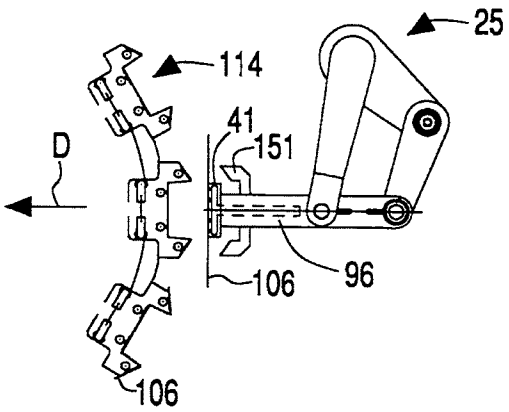
FIG. 16 is an enlarged detail of FIG. 2.

Furthermore, in the further version of the packaging machine 1 the positioning means 25 include folding means 151 (FIG. 16).

Figure 12:
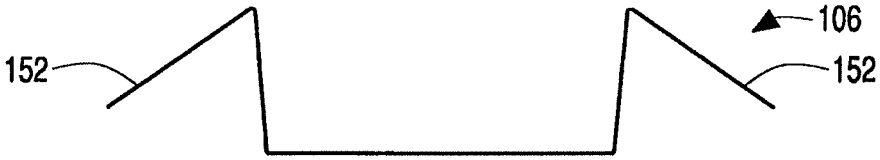
FIG. 12 is a front schematic view of a further inner containing element, or collar, of the further packet of smoking articles.

The folding means comprise a folding element 151, having a "C" shape, in order to fold toward the outside end zones 152 of the collars 106 (FIG. 12).

In particular, the ends of the folding element 151 have a complementary profile with respect to a profile of the external walls 118.

Figure 17:
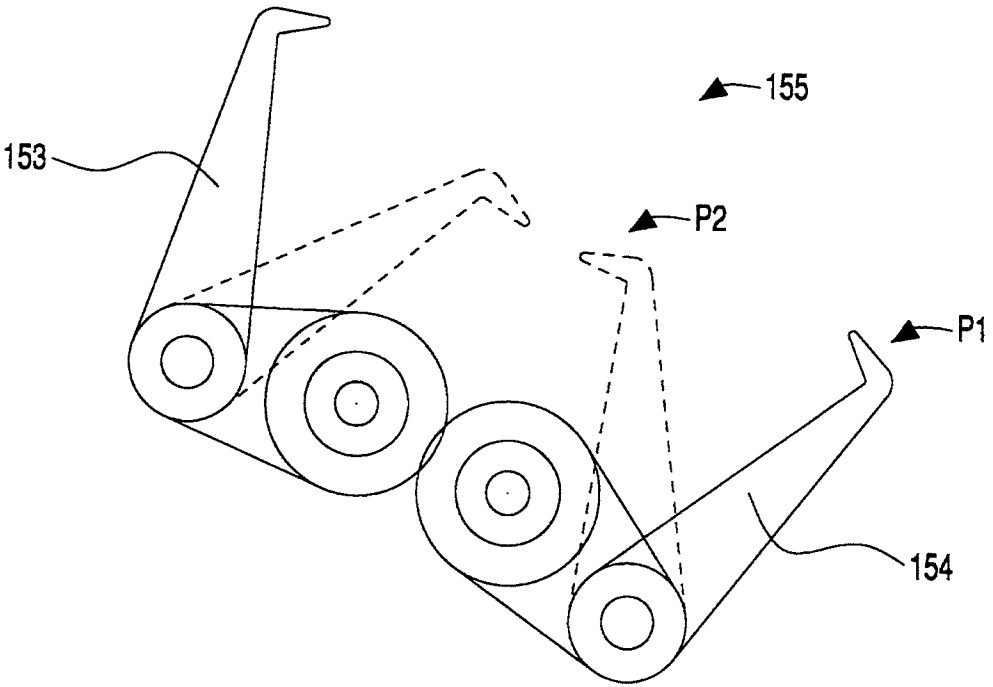
FIG. 17 is a further enlarged detail of FIG. 2.

In this version, moreover, the packaging machine 1 comprises operating means 155 (FIGS. 2 and 17) to fold the end zones 152 toward the inside, so that each collar 106 wraps on four sides the relative group of cigarettes 5 packed in the inner wrapping sheet 4, and to keep the end zones pressed against the relative group of cigarettes 5 packed in the inner wrapping sheet 4.

The operating means 155 are positioned in correspondence to a folding station SP (FIG. 2) of the wrapping wheel 13, the folding station SP being positioned between the first loading station PSC and the third loading station TSC along the wrapping path P.

The operating means 155 comprise a first arm element 153 and a second arm element 154. The first arm element 153 and the second arm element 154 are connected to each other by means of suitable levers and are mobile, with alternate motion, between a first spread position P1 and a closed position P2, shown with a line of dashes in FIG. 17.

During use, during the movement between the spread position P1 and the closed position P2, the first arm element 153 and the second arm element 154 cooperate in order to fold toward the inside the end zones 152 so that each collar 106 wraps on four sides the relative group of cigarettes 5 packed in the inner wrapping sheet 4, and in order to keep the end zones pressed against the relative group of cigarettes 5 packed in the inner wrapping sheet 4.

During functioning, the positioning means 25 position a respective collar 106 radially, in succession, in each empty peripheral pocket 114, in correspondence to the second loading station SSC.

Each collar 106 is pressed and folded by means of the punch element 41 and the folding element 151, respectively against the abutment profile 117 and the external walls 118.

Subsequently, the collar 106 is retained, by means of the above retaining means 150, against the abutment profile 117 and against the external walls 118 of the relative peripheral pocket 114.

Subsequently again, the collars 106 are moved along the wrapping path P and are stopped in succession in correspondence to the first loading station PSC.

In the first loading station PSC the transfer means 22 transfer radially, in succession, each group of cigarettes 5 packed in a relative inner wrapping sheet 4, from the movement means 9 to the wrapping wheel 13 into a respective compartment 116 retaining a collar 106.

In this way, each group of cigarettes 5 packed in a relative inner wrapping sheet 4 is wrapped on three sides by a respective collar 106.

Subsequently again, the anchoring means 19 of the peripheral pocket 114 positioned in the first loading station PSC are moved from the release position to the retaining position PT, so as to retain the group of cigarettes 5 packed in the inner wrapping sheet 4, and at least partially wrapped, that is, on three sides, by the collar 106, anchored to the peripheral pocket 114. Subsequently, the groups of cigarettes 5 packed in the inner wrapping sheet 4, and at least partially wrapped by the collars 106, are moved along the wrapping path P and are stopped in succession in correspondence to the folding station SP.

In the folding station SP the first arm element 153 and the second arm element 154 cooperate to fold toward the inside the end zones 152 so that each collar 106 wraps on four sides the relative group of cigarettes 5 packed in the inner wrapping sheet 4, and to keep the end zones pressed against the relative group of cigarettes 5 packed in the inner wrapping sheet 4.

Subsequently, the groups of cigarettes 5 packed in the inner wrapping sheet 4, and wrapped on four sides by the collars 106, are moved along the wrapping path P and are stopped in succession in correspondence to the third loading station TSC.

In the third loading station TSC the further transfer means 26 transfer radially, in succession, each second wrapping sheet 8 onto a relative peripheral pocket 114 above a relative group of cigarettes 5 packed in an inner wrapping sheet 4, and at least partially wrapped, that is, on four sides, by a respective collar 106.

In correspondence to the third loading station TSC, the retaining means 150 of the peripheral pocket 114 positioned in correspondence to the lateral walls 118 are driven, in order to retain the second wrapping sheet 8 anchored to the peripheral pocket 114.

In particular, each peripheral zone 33 of a second wrapping sheet 8 is pressed by the respective end of the end portion 32, having a complementary profile with respect to a profile of the external walls 118, against a relative external wall 118, and is retained against the latter by the retaining means 150.

Subsequently, the groups of cigarettes 5 packed in the inner wrapping sheets 4, and wrapped on four sides by the collars 106 and at least partially by the second wrapping sheets 8, are moved along the wrapping path P and are stopped in succession in correspondence to the unloading station SS.

In the unloading station SS the retaining means 150 of the peripheral pocket 114 are released and the anchoring means 19 are driven in the release position, so as to allow the other transfer means 37 to transfer radially, in succession, a relative group of cigarettes 5 packed in an inner wrapping sheet 4, and at least partially wrapped by a collar 106 and by a second wrapping sheet 8, from each of the peripheral pockets 114 to each of the further peripheral pockets 36.

Subsequently again, each group of cigarettes 5 packed in an inner wrapping sheet 4, and wrapped on four sides by a collar 106 and at least partially by a second wrapping sheet 8, is moved by the further wrapping wheel 34 along the further wrapping path UP along which a relative second wrapping sheet 8 is completely folded around each of the groups of cigarettes 5 in order to form the packet 3.

Subsequently the packets 3 thus formed are transferred radially to the unloading conveyor 40 and unloaded from the packaging machine 1.

It should be noted that thanks to the second loading station SSC and to the third loading station TSC it is possible to reduce the bulk of the packaging machine 1 comprising the wrapping wheel 13.

Indeed, the second loading station SSC and the third loading station TSC allow to load in succession, on a single wrapping wheel 13, both the first wrapping sheets 6, 106, for example collars, and also the second wrapping sheets 8, for example outer wrapping sheets, and therefore to wrap, at least partially, the groups of cigarettes 5 packed in an inner wrapping sheet 4 on a single wrapping wheel 13.

In other words, this makes it possible to wrap, at least partially, the groups of cigarettes 5 packed in an inner wrapping sheet 4 on a single wrapping wheel 13 instead of on two wrapping conveyors, that is, the first and the second conveyor provided in the packaging machine described in IT1158537, which makes it no longer necessary to have the two separate wrapping conveyors with the respective loading/unloading stations.

It is obvious that, as well as reducing the bulk of the packaging machine 1 as described above, this makes the latter even more simple structurally and less costly with respect to known packaging machines.

Moreover, thanks to the transfer means 22 it is possible to render the packaging machine 1 even more compact with respect to known packaging machines. Indeed, the transfer means 22 allow to transfer the groups of cigarettes 5 wrapped by the inner wrapping sheets 4 in the transfer direction T which is radial with respect to the wrapping path P, thus reducing a transverse bulk of the packaging machine 1.

In this case, the transfer means 22 are positioned and act radially with respect to the wrapping wheel 13 and not, as described with reference to known packaging machines, at the rear with respect to the first wrapping conveyor.

Figure 18:
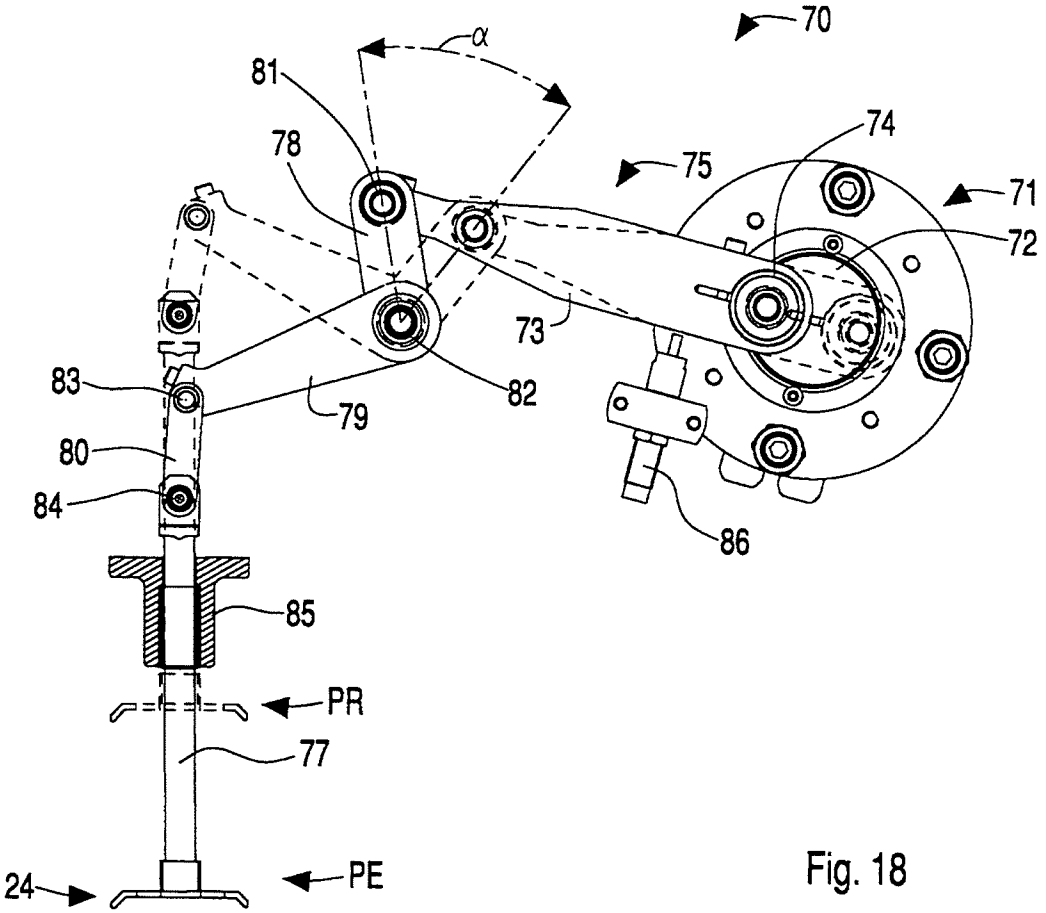
FIG. 18 is a lateral view of a drive system included in the packaging machines in FIGS. 1 and 2.

With reference to FIG. 18 a drive system 70 is shown to drive the second thruster element 24 between a retracted position PR, shown with a line of dashes, and an extracted position PE.

The drive system 70 comprises an electric motor 71, advantageously a step motor of the brushless type (only shown schematically in FIG. 1), provided with a rotor 72.

The drive system 70 also includes an articulated quadrilateral 75 connected to the rotor 72. The articulated quadrilateral 75 comprises a pin 74, mounted eccentric with respect to the rotor 72 and acting as a handle, a connecting rod 73 hinged to the pin 74, and a rocker arm 78 hinged to the connecting rod 73, the last element of the articulated quadrilateral 75 being fixed and defined by a portion of a base 90 (FIGS. 1, 2 and 3) of the packaging machine 1.

In particular the rocker arm 78 is hinged at its first end to a first hinge 81, to which a free end of the connecting rod 73 is also hinged, and at a further first end to a second hinge 82, the second hinge 82 being attached to the base 90 of the packaging machine 1.

During functioning, the pin 74, driven in rotation by the rotor 72, performs an alternate rotational motion along a circumference arc, defining the work travel of the pin 74, of an amplitude substantially equal to 180°.

In its turn the connecting rod 73, driven by the pin 74, performs a roto-translatory motion, while the rocker arm 78, driven by the connecting rod 73, performs an alternate rotational motion along a work arc α, defining the work travel of the rocker arm 78.

In particular the work arc α has an amplitude of less than 180°; the amplitude determines the work travel effected by the second thruster element 24 between the retracted position PR and the extracted position PE.

The drive system 70 also comprises a plurality of levers 77, 79, 80 interposed between and connecting the articulated quadrilateral 75 and the second thruster element 24. The levers comprise a first lever 79, a second lever 80 and a third lever 77.

The first lever 79, hinged to the second hinge 82, is rigidly connected to the rocker arm 78.

In this way, when functioning, the rocker arm 78 and the first lever 79 form a rigid element in the shape of an "L", rotatable around the second hinge 82.

The free end of the first lever 79 is in its turn hinged, by means of a third hinge 83, to the second lever 80, which is hinged by means of a fourth hinge 84 to the third lever 77 supporting the second thruster element 24, the connecting rod 73 with the rocker arm 78, the first lever 79 with the third lever 80, and the latter with the third lever 77 forming turning pairs. The third lever 77 is in turn sliding in a guide 85, forming a prismatic pair with it.

The drive system 70 also comprises a damper 86 in order to dampen any possible extra travels of the connecting rod 73, where by extra travel we mean the travel of the connecting rod 73 in an arc of circumference greater than 180°.

In one version of the invention, not shown, the drive system 70 is not provided with the damper 86.

As mentioned before, when in use the rotor 72 drives the pin 74 with an alternate rotational motion along the circumference arc.

In its turn the pin 74 moves the connecting rod 73 with roto-translatory motion and the connecting rod 73 drives the rocker arm 78 with an alternate rotational motion along the work arc α, the rocker arm 78 moving with alternate motion, by means of the levers 77, 79 and 80, the second thruster element 24 between the retracted position PR and the extracted position PE.

In this way, the articulated quadrilateral 75 transforms the rotational motion of the rotor 72 into an alternate motion of the second thruster element 24.

In the event of malfunctioning, the damper 86 dampens the possible extra travel of the connecting rod 73.

A similar system, and therefore not shown, can be used to move the first thruster element 23, the further first thruster element 38, the further second thruster element 39 and the operating means 155.

Figure 19:
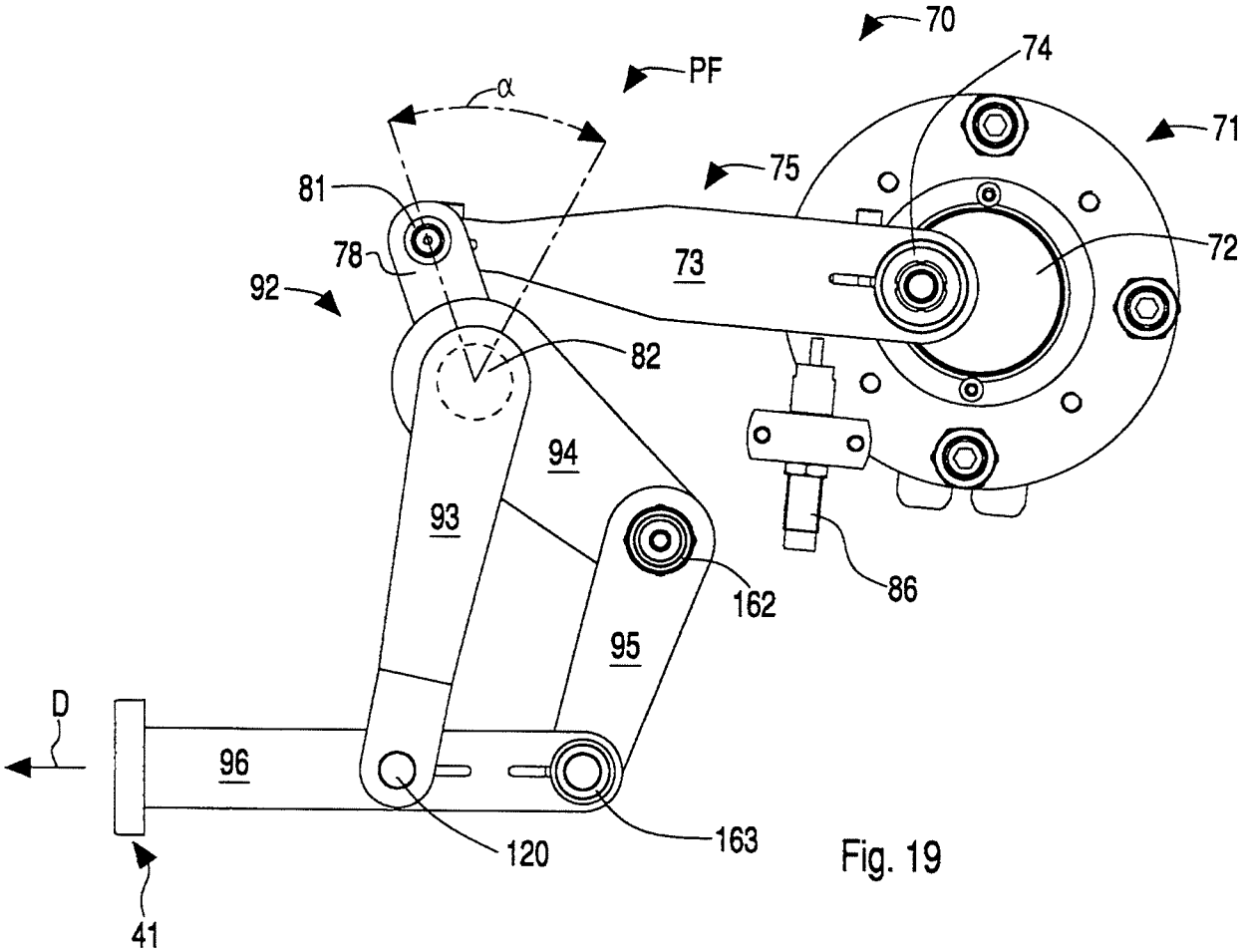
FIG. 19 is a lateral view of another drive system included in the packaging machines in FIGS. 1 and 2.

With reference to FIG. 19 a variant of the drive system 70 is shown, able to drive the punch element 41, and where present, the folding element 151 of the positioning means 25, in the direction D between a retracted position PF and a forward position, not shown.

The variant of the drive system 70 comprises the electric motor 71, provided with a rotor 72, and the articulated quadrilateral 75 connected to the rotor 72, the articulated quadrilateral 75 comprising the pin 74, assembled eccentric with respect to the rotor 72 and acting as a handle, the connecting rod 73 hinged to the pin 74, and the rocker arm 78 hinged to the connecting rod 73, the last element of the articulated quadrilateral 75 being fixed and defined by a portion of a base 90 (FIGS. 1, 2 and 3) of the packaging machine 1.

In particular the rocker arm 78 is hinged at a first end to the first hinge 81 to which a free end of the connecting rod 73 is also hinged, and at its other first end to the second hinge 82, shown here with a line of dashes, the second hinge 82 being attached to the base 90 of the packaging machine 1.

During functioning, the pin 74, driven in rotation by the rotor 72, performs an alternate rotational motion along the circumference arc, defining the work travel of the pin 74, with an amplitude substantially equal to 180°.

In turn the connecting rod 73, driven by the pin 74, performs a roto-translatory motion, while the rocker arm 78, driven by the connecting rod 73, performs an alternate rotational motion along the work arc α, defining the work travel of the rocker arm 78.

In particular the work arc α has an amplitude of less than 180°; the amplitude determines the work travel performed by the punch element 41, and where present, by the folding element 151 of the positioning means 25, between the retracted position PF and the forward position.

The variant also provides, instead of the levers 77, 79, 80, a further articulated quadrilateral 92, interposed between and connecting the articulated quadrilateral 75 and the punch element 41 and where present, the folding element 151 of the positioning means 25.

The articulated quadrilateral 92 comprises a first rocker arm 93, a member 94, a second rocker arm 95 and a further connecting rod 96, the further connecting rod 96 supporting at one end 10 the punch element 41 and possibly the folding element 151.

The first rocker arm 93, hinged to the second hinge 82, is rigidly connected to the rocker arm 78. In this way the rocker arm 78 and the first rocker arm 93 form a rigid element in the shape of a widened "L", rotatable around the second hinge 82.

The articulated quadrilateral 92 also comprises a third hinge 162 fixed to the base 90 of the packaging machine 1, the second hinge 82 and the third hinge 162 being connected by the member 94.

In this way, when in use, the member 94 is fixed with respect to the base 90.

The second rocker arm 95 is also hinged to the third hinge 162.

The free end of the second rocker arm 95 is in its turn hinged, by means of a fourth hinge 163, to the further connecting rod 96, the latter being connected, in an adjustable manner, with a free end of the first rocker arm 93 by means of a fifth hinge 120.

The connecting rod 73 with the rocker arm 78 and the first rocker arm 93 with the member 94, the second rocker arm 95 and the further connecting rod 96 form turning pairs.

In this variant too, the damper 86 is also provided to dampen possible extra travels of the connecting rod 73.

In one version of the variant, not shown, the damper 86 is not present.

During use, the rotor 72 drives the pin 74 with alternate rotational motion along the arc of the circumference.

In turn, the pin 74 moves the connecting rod 73 with a roto-translatory motion and the connecting rod 73 drives the rocker arm 78 with an alternate rotational motion along the work arc $\alpha$, the rocker arm 78 moving, with alternate motion and by means of the further articulated quadrilateral 92, the punch element 41 and when present the folding element 151 of the positioning means 25, between the retracted position PF and the forward position.

In this way the articulated quadrilateral 75 transforms the rotational motion of the rotor 72 into an alternate motion of the punch element 41 and possibly of the folding element 151 of the positioning means 25.

In the event of malfunctioning, the damper 86 dampens the possible extra travel of the connecting rod 73.

A similar system, and therefore not shown, can be used to move the first transfer arm 29 and the second transfer arm 31.

It should be noted how the articulated quadrilateral 75 allows to improve the known drive systems.

In fact, in the event of a malfunction, the articulated quadrilateral 75 intrinsically limits the movements of the operating unit to which it is connected, which prevents the latter from knocking against other parts of the packaging machine 1.

Moreover, thanks to the articulated quadrilateral 75 described above, the drive system 70 is more reliable than known drive systems.

Indeed, the articulated quadrilateral 75 acts as a reducer, reducing the moment of inertia of the moving masses, that is, the operating unit to which it is connected, so that the moment of inertia does not exceed a determinate value of moment of inertia of the rotor 72.

It is obvious that for this reason the reducer used in known drive systems is no longer necessary.

Furthermore, the moderate deterioration of the turning pairs described above allows to reduce to a great extent the frequency of maintenance operations.

In one version of the invention, not shown, instead of or together with the transfer wheel 27, one or more conveyors are provided, equipped with respective retaining elements each disposed to retain a respective second wrapping sheet 8.

Furthermore, the conveyors, substantially coplanar to the wrapping wheel 13, to the further wrapping wheel 34 and where present to the transfer wheel 27, are driven in rotation step-wise by an electric motor, not shown, around respective axes substantially parallel to the axis of rotation R.

Furthermore, the packaging machine 1 comprises a management and control unit 100 of the programmable type (only shown schematized in FIG. 1), in order to manage and command the electric motors 71, of the first thruster element 23 and of the second thruster element 24, of the transfer means 22, of the further first thruster element 38 and of the further second thruster element 39 of the other transfer means 37, of the positioning means 25, of the operating means 155, of the first transfer arm 29, of the second transfer arm 31 and the electric motors 91, of the movement means 9, of the wrapping wheel 13, of the transfer wheel 27, of the conveyors and of the further wrapping wheel 34.

The invention claimed is:

1. A packaging machine for forming a packet of smoking articles, comprising:

a central wrapping wheel configured for forming a partially wrapped product, the partially wrapped product including a group of smoking articles wrapped in an inner wrapping sheet that is at least partially wrapped in an inner containing element and an outer wrapping sheet, wherein the central wrapping wheel comprises peripheral housing pockets and a suction cup retaining means, components of said packaging machine lying on a vertical plane, at least one of the peripheral housing pockets is configured to house the inner containing element, the outer wrapping sheet, and the group of smoking articles wrapped in the inner wrapping sheet, and to form the partially wrapped product, wherein the group of smoking articles wrapped in the inner wrapping sheet is retained in the one of the peripheral housing pockets via the suction cup retaining means;

a movement means configured for moving the group of smoking articles wrapped in the inner wrapping sheet toward the one of the peripheral housing pockets of the central wrapping wheel;

a transfer means configured for transferring in a direction radial to the central wrapping wheel the group of smoking articles wrapped in the inner wrapping sheet from the movement means into one of the peripheral housing pockets of the central wrapping wheel and for removing the group of smoking articles from movement means substantially orthogonal to said vertical plane, said transfer means lying on said vertical plane;

a positioning means configured for transferring the inner containing element in the direction radial to the central wrapping wheel and into the one of the peripheral housing pockets of the central wrapping wheel, said positioning means lying on said vertical plane;

a wheel-type transfer means configured for transferring the outer wrapping sheet in a direction radial to the suction cup retaining means into the one of the peripheral housing pockets of the central wrapping wheel, said wheel-type transfer means lying on said vertical plane, said peripheral pockets of the central wrapping wheel configured for radially delivering a material for forming the packet to a wheel-type final packaging and wrapping means; and the wheel-type final packaging and wrapping means configured for receiving the partially wrapped product from the one of the peripheral housing pockets, and for forming the packet from the partially wrapped product, said wheel-type final packaging and wrapping means lying on a substantially vertical plane, wherein the central wrapping wheel, the positioning means, the wheel-type transfer means, and the wheel-type final packaging and wrapping means are each directly associated with one of electric step motors of the brushless type, the electric step motors being governed by a programmable central command and control unit.

2. The machine as in claim 1, wherein the central wrapping wheel comprises:

a first loading station to load the group of smoking articles wrapped in the inner wrapping sheet into the one of the peripheral housing pockets;

a second loading station to load the inner containing element into the one of the peripheral housing pockets; and a third loading station to load the outer wrapping sheet into the one of the peripheral housing pockets.

3. The machine as in claim 2, wherein the central wrapping wheel is configured to advance step-wise along a wrapping path.

4. The machine as in claim 3, wherein the second loading station is positioned upstream of the first loading station with respect to the wrapping path.

5. The machine as in claim 3, wherein the third loading station is positioned downstream of the first loading station with respect to the wrapping path.

6. The machine as in claim 3, wherein the transfer means move the group of smoking articles wrapped in the inner wrapping sheet and the outer wrapping sheet along a transfer direction which is substantially perpendicular with respect to the wrapping path.

7. The machine as in claim 1, wherein the one of the peripheral housing pockets comprises abutment means and retaining means in order to retain the inner containing element against the abutment means.

8. The machine as in claim 7, wherein the retaining means comprise vacuum-gripping means.

9. The machine as in claim 1, wherein the one of the peripheral housing pockets comprises anchoring means in order to retain the group of smoking articles wrapped in the first inner wrapping sheet by the inner containing element.

10. The machine as in claim 9, wherein the anchoring means are mobile between a release position, in which the group of smoking articles wrapped in the inner wrapping sheet which is wrapped, at least partially, by the inner containing element is able to be inserted into or taken out of the one of the peripheral housing pockets, and a retaining position, in which the group of smoking articles wrapped in the inner wrapping sheet which is wrapped, at least partially, by the inner containing element is retained in the one of the peripheral housing pockets.

11. The machine as in claim 1, wherein the group of smoking articles wrapped in the inner wrapping sheet has a large side and a small side, and the transfer means are configured to transfer in succession one or more of the group of smoking articles wrapped in the inner wrapping sheet into the one of the peripheral housing pockets above the inner containing element so that the large side faces the one of the peripheral housing pockets.

12. The machine as in claim 1, wherein the central wrapping wheel comprises a folding and abutment station to fold toward an inside end zone of the inner containing element so as to at least partially wrap the group of smoking articles wrapped in the inner wrapping sheet, and to abut the folded end zone so as to maintain the end zone being pressed against the group of smoking articles wrapped in the inner wrapping sheet.

13. The machine as in claim 12, wherein the central wrapping wheel comprises:

a first loading station to load the group of smoking articles wrapped in the inner wrapping sheet into the one of the peripheral housing pockets;

a second loading station to load the inner containing element into the one of the peripheral housing pockets; and a third loading station to load the outer wrapping sheet into the one of the peripheral housing pockets, wherein the folding and abutment station is interposed between the first loading station and the third loading station.

14. The machine as in claim 1, further comprising:

an unloading station for transferring the partially wrapped product into a further peripheral pocket of the wheel-type final packaging and wrapping means to complete folding of the partially wrapped product to form the packet containing the group of smoking articles wrapped in the inner wrapping sheet.

15. The machine as in claim 14, wherein the central wrapping wheel comprises:

a first loading station to load the group of smoking articles wrapped in the inner wrapping sheet into the one of the peripheral housing pockets;

a second loading station to load the inner containing element into the one of the peripheral housing pockets; and a third loading station to load the outer wrapping sheet into the one of the peripheral housing pockets, wherein the central wrapping wheel is configured to advance step-wise along a wrapping path, and the unloading station is positioned downstream of the third loading station with respect to the wrapping path.

16. The machine as in claim 14, further comprising:

another transfer means to transfer the partially wrapped product having a small side and a large side, the large side facing the peripheral housing pocket, from the one of the peripheral housing pockets into the further peripheral pocket so that a side opposite the large side faces the further peripheral pocket.

17. The machine as in claim 16, wherein the central wrapping wheel is configured to advance step-wise along a wrapping path, and the another transfer means move the group of smoking articles wrapped in the inner wrapping sheet along another transfer direction which is substantially perpendicular with respect to the wrapping path.

* * * * *